US006923565B2

(12) United States Patent
Johnson

(10) Patent No.: US 6,923,565 B2
(45) Date of Patent: Aug. 2, 2005

(54) PROCESS AND EQUIPMENT FOR PRODUCING CONCRETE PRODUCTS HAVING BLENDED COLORS

(75) Inventor: Jay Jeffrey Johnson, Star Prairie, WI (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 88 days.

(21) Appl. No.: 10/127,871

(22) Filed: Apr. 22, 2002

(65) Prior Publication Data

US 2003/0198122 A1 Oct. 23, 2003

(51) Int. Cl.[7] ..... B28C 5/00; B28C 7/04

(52) U.S. Cl. ..... 366/2; 366/8; 366/10; 366/16

(58) Field of Search ..... 366/2, 6, 8, 152.6, 366/152.1, 160.1, 10, 16

(56) References Cited

U.S. PATENT DOCUMENTS

| | | | | |
|---|---|---|---|---|
| 3,425,105 | A | 2/1969 | Guide | |
| 4,050,864 | A | 9/1977 | Komaki | |
| 4,178,340 | A | 12/1979 | Hyytinen | |
| 4,802,836 | A | 2/1989 | Whissell | |
| 5,056,998 | A | 10/1991 | Goossens | |
| 5,435,949 | A | 7/1995 | Hwang | |
| 5,534,214 | A | 7/1996 | Sakamoto et al. | |
| 5,651,912 | A | 7/1997 | Mitsumoto et al. | |
| 6,382,947 | B1 * | 5/2002 | Bryant | 425/130 |

FOREIGN PATENT DOCUMENTS

| | | | |
|---|---|---|---|
| DE | 200 11 041 U1 | | 11/2000 |
| FR | 2 636 658 | | 3/1990 |
| JP | 9-38922 | | 2/1977 |
| JP | 06143221 A | | 5/1994 |
| JP | 0911222 | * | 1/1997 |
| JP | 09038923 | | 2/1997 |
| JP | 09123149 | * | 5/1997 |

OTHER PUBLICATIONS

Color & Chemical Technologies, Inc., Technical Data Sheet, Mar. 2002, 1 page.

Besser Co., Founders Spray Machine. http://www.besser.com/equipment/productenhance/founderspray.htm, printed Jun. 2002, 2 pages.

Besser Co., Press Release dated Jan. 29, 2001, Founders Spray Machine, 1 page.

* cited by examiner

*Primary Examiner*—Tony G. Soohoo
(74) *Attorney, Agent, or Firm*—Merchant & Gould P.C.

(57) ABSTRACT

A process and equipment for producing multi-color concrete products, including architectural concrete blocks, concrete bricks, modular concrete products that are suitable for use in landscaping applications, such as retaining wall blocks, concrete pavers, and concrete slabs. The invention includes a hopper that is divided into separate sections, with each section intended to contain a differently colored concrete. Each hopper section includes a controllable discharge opening that permits precise control of the amount of each concrete color that is discharged from the hopper. The colored concrete is then transported to and dumped into a hopper of a concrete product production machine, where the concrete is blended into a multi-color concrete blend for use in producing the concrete products.

12 Claims, 5 Drawing Sheets

(1 of 5 Drawing Sheet(s) Filed in Color)

PROCESS AND EQUIPMENT FOR PRODUCING CONCRETE PRODUCTS HAVING BLENDED COLORS

FIELD OF THE INVENTION

The invention relates generally to the production of concrete products. More specifically, the invention relates to a production process in which concretes of different colors are blended together in such a way that the final product is not a uniform color, but has a variegated appearance that might be described as swirled, folded, or mottled. Most specifically, the invention relates to the production of such concrete products in a dry cast process. Concrete products to which the invention can be applied include, but are not limited to, architectural concrete blocks, concrete bricks, and concrete blocks that are suitable for use in landscaping applications, such as retaining wall blocks, pavers, and slabs.

BACKGROUND OF THE INVENTION

Concrete products can be produced without any coloring agents, in which case the resulting product will have a color dictated by the native colors of the raw materials, typically cement and aggregate, that have been used. The result is typically a shade of gray. It is possible to alter this gray color by introducing a coloring agent into the mixture. The coloring agent is typically a pigment, or a mixture of pigments, that will impart the desired color to the finished product.

There are a variety of known processes for making concrete products. In a wet cast system, a concrete mixture that contains sufficient water so that it flows readily is introduced into a closed mold. The mixture is allowed to harden in the mold, and the molded product is then stripped from the mold. In a dry cast system, a much drier concrete mixture is introduced into a mold. The concrete mixture is densified in the mold, and then removed from the mold before it has hardened. Because the concrete mixture is of a "low slump" or "no slump" nature, the molded product, if carefully handled, will retain its molded shape while it is transported to a curing area, where it will cure over a period of hours. This dry cast process is suitable for highly automated, mass production of a number of types of concrete products, including architectural concrete blocks, segmental retaining wall units, concrete bricks, slabs, and interlocking concrete pavers.

In recent years, it has become desirable to produce some of these products with variegated colors, rather than with uniform colors. The variegated color products will have two or more distinct colors visible in the finished product, with the colors folded, or swirled, or mottled in some fashion. This is a popular look in landscape products in particular, where the appearance of naturally-occurring, variegated colored stone is being sought. In this specification, the term "color blended" will be used to refer to such a variegated color appearance.

An example of a known dry cast concrete product production system 5 is illustrated in FIG. 1. The system 5 includes a mixer 6 in which a batch of the low slump concrete is mixed from known components. After mixing, the batch of uncured concrete is transported by a conveyor 7 to a surge hopper 8, with the concrete being deposited into the hopper 8. Uncured concrete is then metered from the hopper 8 onto a metering belt 9 which transports the metered amount of concrete to a production machine 10 which forms a plurality of concrete products from the concrete.

The production machine 10 includes a hopper 15 that receives the concrete from the metering belt 9. The production machine 10, as would be understood by a person having ordinary skill in the art, includes molds that are open at the top and bottom. A pallet is positioned below each mold to close the bottom of the mold, and the uncured concrete is delivered from the hopper 15 into each mold through the open top of the mold via one or more feed drawers. The uncured concrete is then densified and compacted by a combination of vibration and pressure. The mold is then stripped by a relative vertical movement of the mold and the pallet to remove the uncured concrete product from the mold. The uncured product is then transported to a location where it is cured. The production machinery needed to construct a system of this type is available from Besser Company of Alpena, Mich., as well as from a number of other sources, including Columbia Machine Company, Tiger Machine Company, Masa, Omag, Rikers, Hess, KVM, Zenith, and others. Batching and mixing equipment is available from a number of sources well known in the industry. Color pigments are available from a number of sources, including Bayer, Davis Color, and Hamburger Color Company.

Returning to FIG. 1, color blending has previously been achieved by preparing a batch of concrete of a first color and depositing a first colored concrete layer 11 in the hopper 8, preparing a batch of concrete of a second color and depositing a second colored concrete layer 12 in hopper 8 on top of the first layer of concrete 11, and, if a third color is desired, preparing a batch of concrete of a third color and depositing a third colored concrete layer 13 in hopper 8 on top of the second layer 12. For example, the first layer 11 can be black concrete, the second layer 12 can be brown concrete, and the third layer 13 can be gray concrete. Blending of the three colors occurs within the hopper 8, as the concrete is metered from the hopper 8 onto the metering belt 9, on the metering belt 9 itself, and within the production machine 10 prior to being introduced into the molds.

A difficulty with this previous blending process is that the blending of the different colors, and the resulting color blended look of the concrete product, are not controllable. The initial amount of concrete that is metered from the hopper 8 onto the belt 9 is mostly a single color from the layer 11. Therefore, concrete products made from the initial amount of concrete will have little or no color blending, and as a result, will have an appearance that is significantly different from concrete products that are formed from later metered amounts of concrete. These initial products are often discarded due to insufficient blending. In addition, the final amount of concrete from the hopper 8 is often primarily a single color from the layer 13, so that products made from this final amount are also frequently discarded.

Further, the color blending that does occur in the hopper 8 and downstream from the hopper is random, as is the amount of each color contained in the concrete that is metered from the hopper 8 onto the belt 9. Therefore, products produced from one metered amount of concrete may have one look, while products produced from another metered amount of concrete may have an entirely different look. This can be a problem when it is desired to achieve a somewhat consistent color blended appearance.

In addition, the design of the hopper 8 is such that the entire amount of concrete must be used up before new color layers 11–13 can be introduced. Therefore, if the decision is made to change the blended look of the products while concrete remains in the hopper 8, it is generally necessary to use up the remaining concrete in the hopper, or discard the remaining concrete entirely. The need to use up all of the concrete in the hopper 8 also slows down production, since the mixer 6 must then form each color batch for introduction into the hopper 8. While the hopper is being refilled, the production machine 10 may be standing idle waiting for filling to be complete and for new concrete to be metered from the hopper.

Moreover, due to the relatively long time the colors are in contact with each other, the colors can bleed together and produce areas on the resulting products having a color that is a mixture of two or more colors. This bleeding of colors can detract from the appearance of the product, by blurring the colors at the junctures between colors, which blurs the separation between colors in the resulting product.

Accordingly, there is a need for an improved process and equipment for producing color blended concrete products, in which there is more control of the resulting color blended appearance of the products, and at the same time reducing the amount of waste and reducing production down time.

SUMMARY OF THE INVENTION

The invention relates to a process and equipment for high speed, mass production of multi-colored concrete products formed from a multi-color blend of concrete. Preferably, the invention is used to produce concrete products that are suitable for use in landscaping applications, such as retaining wall blocks. The invention can also be used to produce color blended pavers, slabs, and bricks. The visible surfaces of a concrete product resulting from the multi-color blend have a variegated appearance, which, in the case of landscape products, may simulate natural stone or rock.

With the present invention, the amount of each concrete color forming the multi-color blend is precisely controllable. As a result, a more consistent multi-color blend in the concrete can be achieved, so that the color blended appearance of the concrete products is more consistent, and the production of one-color, or otherwise insufficiently color blended products is reduced. The need to discard product due to insufficient color blending is therefore reduced. Further, the ratios of the concrete colors used in the multi-color blend can easily be changed, so that the resulting appearance of the visible surfaces of the concrete products can be readily altered.

In a preferred embodiment, each concrete color that is to form the multi-color blend is held within a segregated section of a first hopper, separate from the other concrete colors. Three monochromatic colors of concrete are used to produce the multi-color blend. A controlled quantity of each monochromatic concrete can be metered from each section of the first hopper, and delivered to a second hopper where the metered quantities of concrete are combined together to form the multi-color concrete blend. The multi-color blend is then used to produce the concrete products.

By maintaining the same blending conditions to produce the multi-color blend, including the amounts of each concrete color discharged from the first hopper, the sequence in which the concrete colors are discharged, and the speed at which the concrete colors are conveyed to the second hopper, the multi-color blend is generally repeatable, which permits generally repeatable production of blocks having a similar appearance.

Because each batch of colored concrete is separated from the other colored batches of concrete within the first hopper, and blending of the colored concrete does not occur until just prior to formation of the products, separation between the colors in the resulting product is more distinct, with less blurring of the colors at junctures between colors, thereby improving the variegated appearance of the visible surfaces of the product. Further, by controlling the amount of each concrete color that is metered from the first hopper, the sequence in which the concrete colors are metered from the first hopper, and the rate at which the metered concrete is delivered to the second hopper, the resulting multi-color concrete blend can be altered, along with the resulting color blended appearance of the concrete products.

The process and equipment of the invention results in a reduction of concrete waste by eliminating the need to dump an entire load of concrete from the surge hopper in the event of improper mixing of one of the concrete colors, such as the addition of excessive water. Instead, with the present invention, each colored concrete batch can be separately dumped in the event of improper mixing of the concrete color. The invention further results in a reduction in production stoppages, as each hopper section can be filled with additional concrete when a hopper section runs low on concrete.

BRIEF DESCRIPTION OF THE DRAWINGS

The patent or application file contains at least one drawing or photograph executed in color. Copies of this patent or patent application publication with color drawing(s) will be provided by the United States Patent and Trademark Office upon request and payment of the necessary fee.

DETAILED DESCRIPTION OF THE PREFERRED EMBODIMENT

Overview

The present invention provides a process for producing multi-color blended concrete products, as well as to a system and equipment utilized in implementing the process. As used in this specification, the term "concrete products" includes architectural concrete blocks that are assembled with mortar to build external walls, concrete bricks, modular concrete products that are suitable for use in landscaping applications, such as retaining wall blocks, concrete pavers, concrete slabs, and other concrete products.

The preferred application of the process, system and equipment is in the dry cast production of blocks that are used in landscaping applications, particularly retaining wall blocks that are designed to be stacked on top of one another in multiple courses to form a retaining wall, without the use of mortar.

Figure 2:
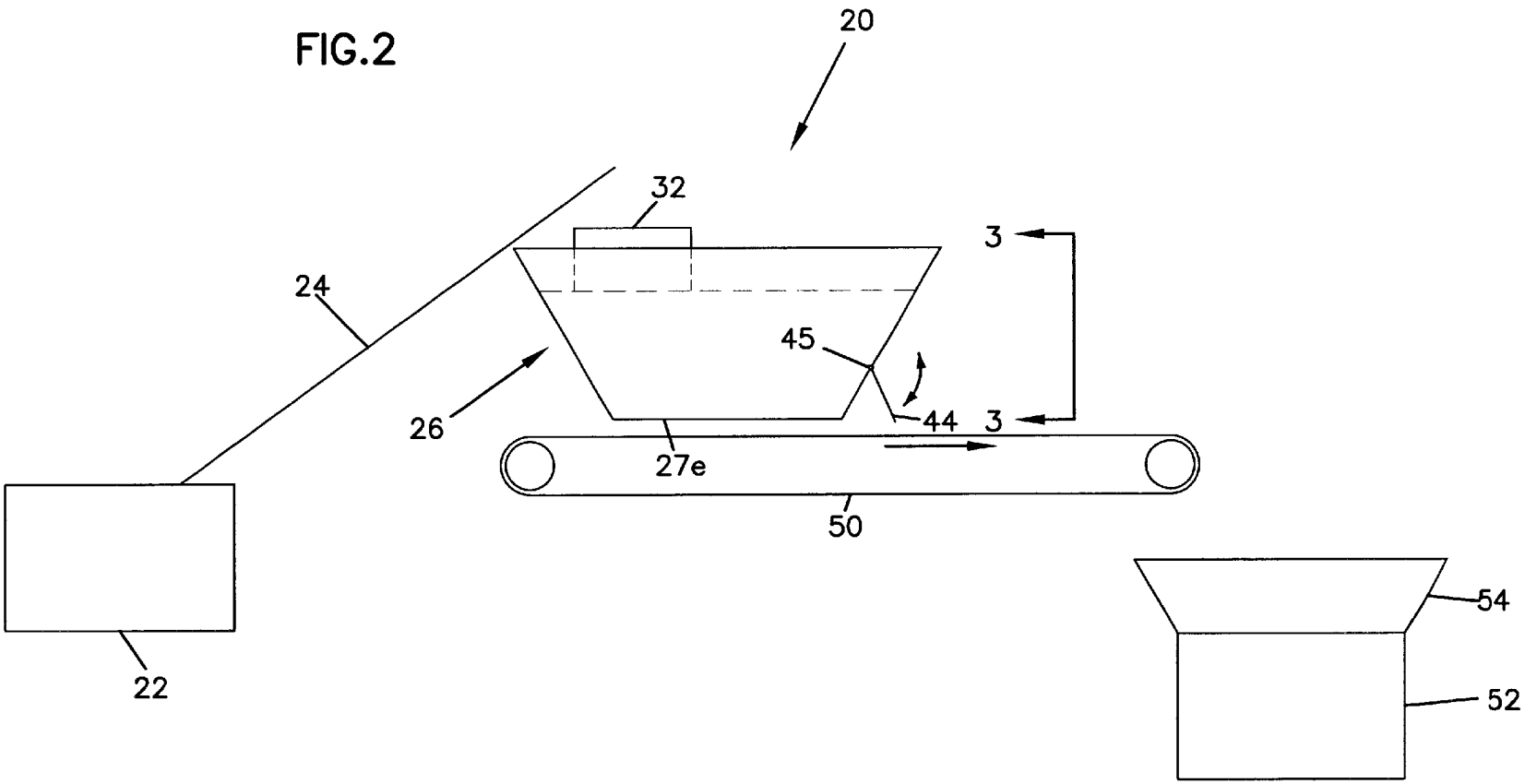
FIG. 2 is a schematic depiction of a dry cast concrete product production system according to the present invention.

FIG. 2 illustrates a dry cast production system 20 according to the present invention. The system 20 includes a mixer 22 that mixes batches of monochromatically colored concrete. The components of the concrete, and the ratios of the components, may vary depending upon the particular application, and the particular mix designs are within the ordinary skill in the art. The components are typically aggregates such as sand and gravel, cement and approximately 5% by weight of water. Other components, depending upon the application, may include pumice, quartzite, taconite, and other natural or man-made fillers, and chemicals to improve such properties as water resistance, cure strength, and the like. In the preferred embodiment, each batch of concrete mixed in the mixer 22 also contains color pigment to color the concrete. The ratios of various ingredients and the types of materials can be selected within the skill of the art and are often chosen based on local availability of raw materials, technical requirements of the end products, and the type of production machine being used. The mixer itself may be of any known type presently used in the industry, including pan-type mixers and ribbon-type mixers. In a currently preferred embodiment, the mixer is of the ribbon-type, and the color pigment is C-grade color, available from Bayer Corp.

After the first, and each subsequent, batch of colored concrete is mixed, it is transported from the mixer 22 by an infeed conveyor 24 to a surge hopper 26 which holds the uncured concrete. The details of the surge hopper 26 are best seen from FIGS. 2–4. The surge hopper 26 includes a plurality of sidewalls 27*a–d* and a bottom wall 27*e* defining an interior volume.

The interior of the surge hopper 26 is divided into a plurality of sections by at least one dividing wall. In the preferred embodiment, two dividing walls 28, 30 divide the interior of the hopper 26 into three sections A, B, and C. However, the hopper 26 could be divided into only two sections, or more than three sections, if desired, depending upon the number of different colors that are to be blended.

Each hopper section A, B, and C receives a differently colored batch of concrete material. For example, section A can receive concrete that is colored black, section B can receive concrete that is colored brown, and section C can receive concrete that is colored gray. The size of the hopper sections A, B, and C can vary. Hopper sections A, B, C that each hold about 70 $ft^3$ of concrete have been tested successfully.

Figure 4:
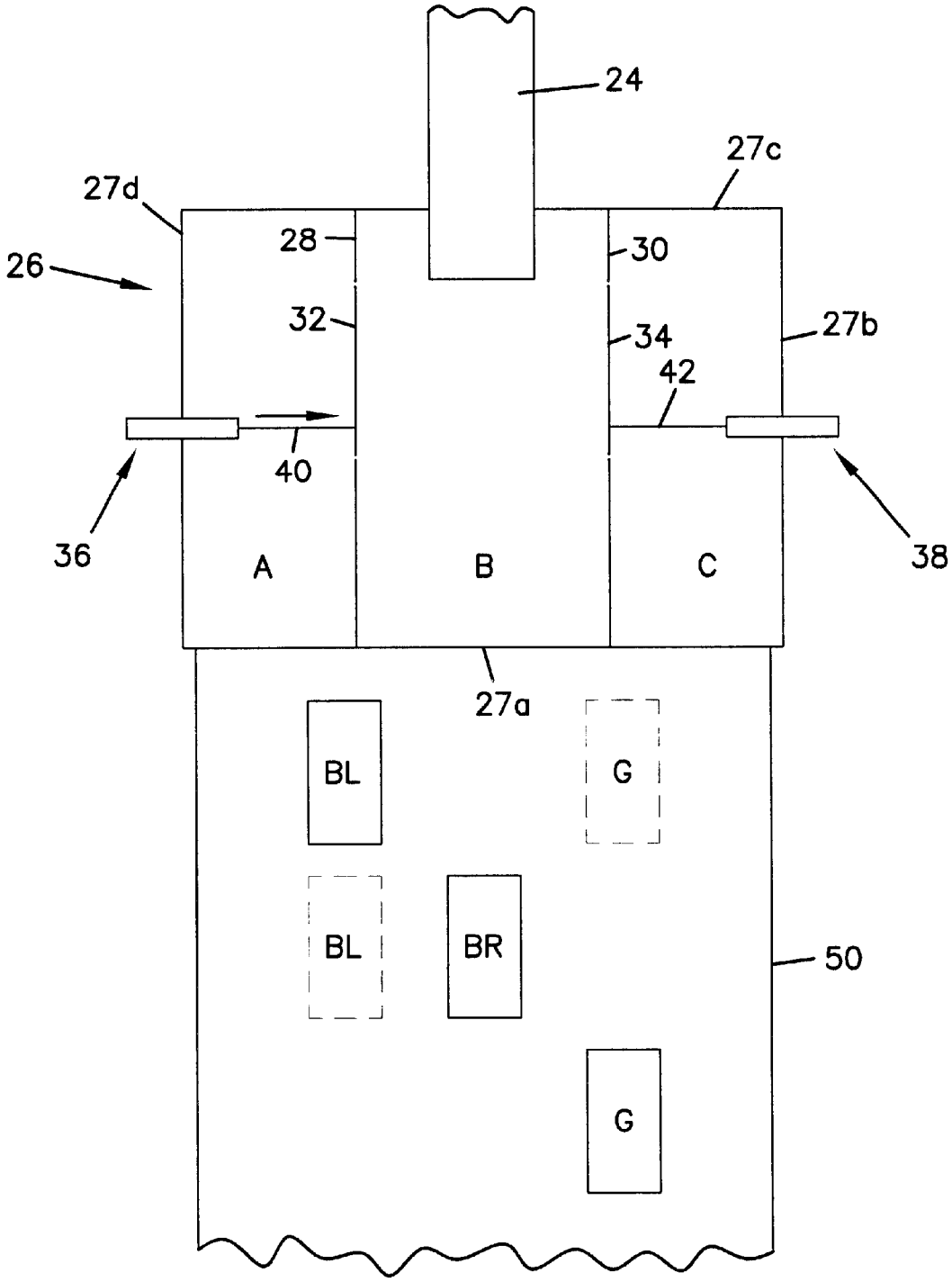
FIG. 4 is a top view of the surge hopper, a portion of the infeed conveyor and a portion of the metering belt of the present invention.

The walls 28, 30 extend between and are fixed to the sidewalls 27*a* and 27*c*, as best seen in FIG. 4, and extend from adjacent the open top of the hopper to the bottom wall 27*e* as best seen in FIG. 2. The walls 28, 30 keep the colored batches separate from each other to prevent intermixing in the hopper.

Means are provided for directing concrete that falls from the end of the conveyor 24 into selected ones of the hopper sections. In the embodiment illustrated in FIGS. 2–4, the means for directing comprise deflection plates 32, 34 that are attached to the top edges of the walls 28, 30. As illustrated in FIG. 4, the position of the conveyor 24 relative to the hopper 26 is such that the concrete from the conveyor 24 would be deposited into hopper section B. However, the plates 28, 30 are selectively positionable to deflect concrete material that falls from the end of the conveyor 24 into hopper sections A or C.

Figure 3:
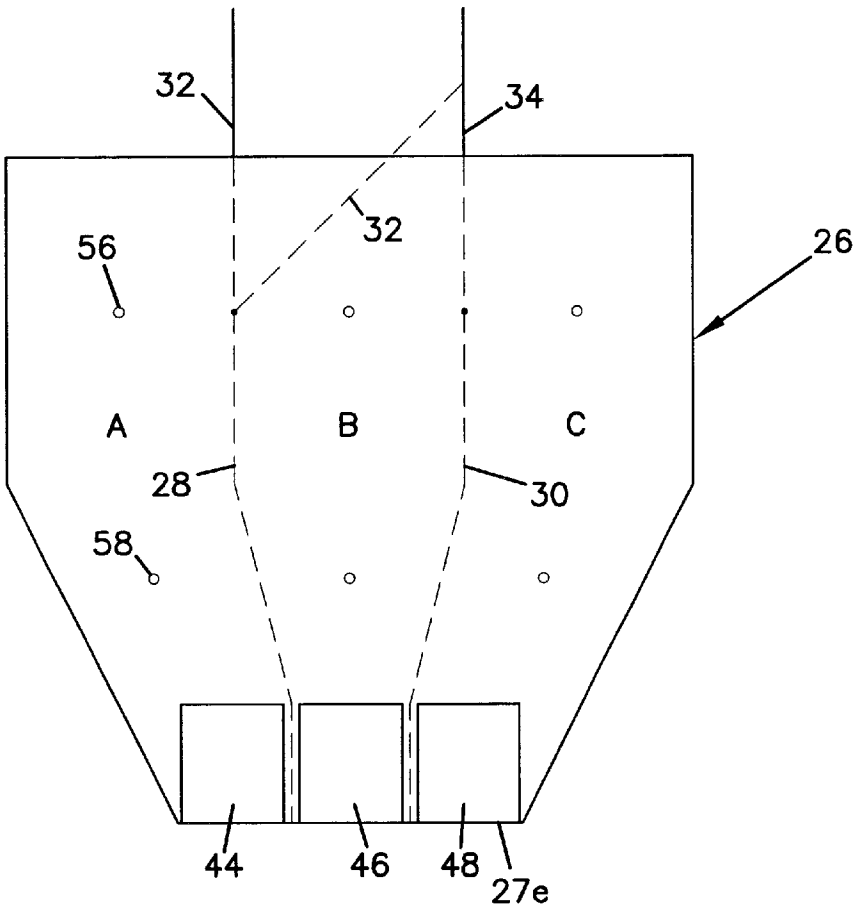
FIG. 3 is a side elevation view of the surge hopper looking in the direction of line 3—3 in FIG. 2.

As shown in FIGS. 2 and 3, the plates 32, 34 extend above the top of the hopper 26 toward the end of the conveyor 24. Further, as shown in FIGS. 2 and 4, the plates 32, 34 extend only partially along the length of the walls 28, 30. The plates 32, 34 are pivotally attached to the top edges of the walls 28, 30 so that the plates 32, 34 can each pivot from a generally vertical position to an angled position, as shown in dashed lines in FIG. 3 for the plate 32.

When the plates 32, 34 are both vertical, as shown in FIG. 4, concrete falling from the end of the conveyor is deposited into hopper section B. To direct concrete into hopper section A, the plate 32 is actuated to its angled position, as shown in dashed lines in FIG. 3, so that the plate 32 is disposed underneath the discharge of the conveyor 24, with the free edge of the plate 32 resting against the plate 34, which remains vertical, for support. As a result, concrete from the conveyor 24 falls onto the angled plate 32 and, due to the angle of the plate, slides down the plate 32 into hopper section A. To direct concrete into hopper section C, the plate 34 is moved to its angled position (not shown), so that the plate 34 is disposed underneath the discharge of the conveyor 24, with the free edge of the plate 34 resting against the plate 32, which remains vertical, for support. As a result, concrete from the conveyor 24 falls onto the angled plate 34 and, due to the angle of the plate, slides down the plate 34 into hopper section C. Therefore, by suitably controlling the positions of the plates 32, 34, concrete can be deposited into the appropriate hopper section A, B, or C.

Movement of the plates 32, 34 is controlled by actuators 36, 38 connected to the plates 32, 34 and fixed to suitable support structure, such as the sidewalls 27*b*, 27*d* of the hopper 26 itself, as seen in FIG. 4. The actuators 36, 38 are preferably pneumatic or hydraulic actuators with actuating rods 40, 42 connected to the plates 32, 34.

With reference to FIG. 3, associated with each hopper section A, B, C adjacent the bottom of the hopper 26 is a discharge opening that is controlled by a respective gate 44, 46, 48. In the preferred embodiment, the discharge openings and gates 44, 46, 48 are each associated with the sidewall 27*a*, adjacent the bottom thereof. The gates 44, 46, 48 control or meter concrete from each hopper section A, B, C through the respective discharge opening and onto a metering belt 50. The metering belt 50 then carries the metered concrete from the respective hopper sections to a concrete product production machine 52 which includes a hopper 54 into which the metered concrete is deposited to produce the multi-color blend. The production machine 52 then forms a plurality of blocks from the multi-color blend.

The gates 44, 46, 48 are designed so as to be selectively openable to allow controlled deposit of colored concrete from each hopper section onto the belt 50. When closed, the gates 44, 46, 48 prevent further deposit of concrete onto the belt 50 until the gates are again opened. Preferably, each gate is separately controllable. Therefore, one gate can be opened while the two other gates are closed, two gates can be opened and one closed, all gates can be opened, or all gates can be closed. As a result, controlled amounts of each color of concrete can be deposited onto the belt 50.

The gates 44, 46, 48 are preferably mounted so as to be pivotable between a closed position, shown in FIG. 3, and an open position. FIG. 2 illustrates gate 44 in the open position, with an arrow indicating movement of the gate 44 about a pivot 45 between the open and closed positions. The gates 46, 48 are likewise pivotable about respective pivots (not shown) between their closed and open positions. An actuator, such as a pneumatic or hydraulic actuator (not shown), is preferably connected to each gate to control gate pivoting between the opened and closed positions. However, the gates could be mounted for movement other than pivoting. For example, the gates could be mounted to slide up and down relative to the hopper 26.

The sizes of the discharge openings and gates 44, 46, 48 are chosen to enable concrete to exit the hopper section when the respective gate 44, 46, 48 opens. Discharge openings and gates that are about 6.0 inches high and about 12.0 inches wide have been tested successfully.

Figure 1:
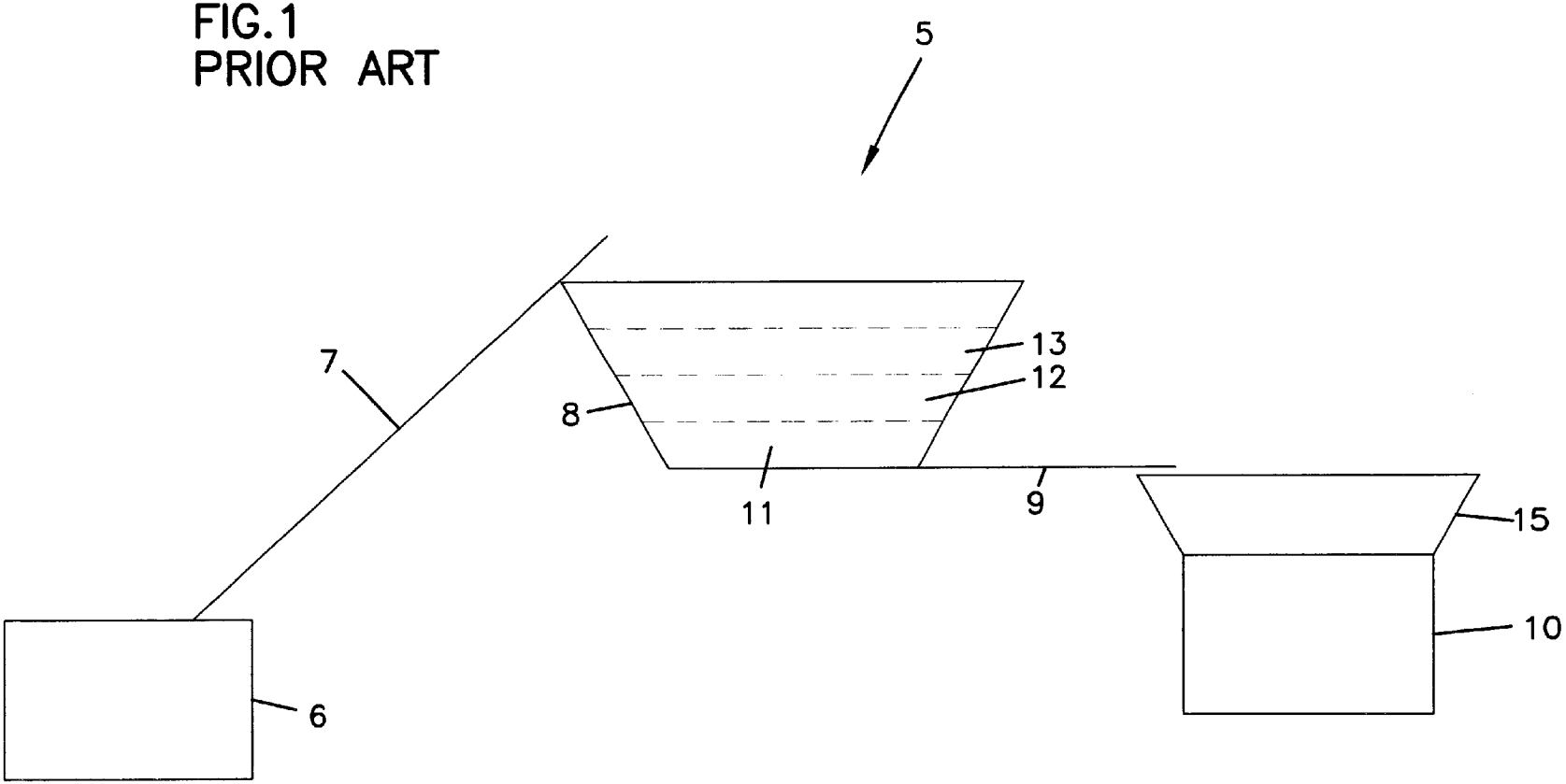
FIG.1 PRIOR ART
FIG. 1 is a schematic depiction of a known dry cast concrete product production system.

The belt 50 is driven by a suitable drive mechanism to deliver the concrete to the hopper 54. Because the belt 50 receives concrete from across substantially the entire width of the hopper 46, the belt 50 needs to be wider than conventional metering belts. Many conventional metering belts, such as the belt 9 in FIG. 1, have a width that is approximately 24 inches. The belt 50, on the other hand, has a much larger width. A belt width that has been found useful is about 42 inches. It is to be realized that a smaller or larger width could be used, as long as the belt 50 is wide enough to receive the concrete that is discharged from each hopper section.

FIG. 4 illustrates an example of the metering function of the gates 44, 46, 48. In this example, it is assumed that hopper section A contains black concrete, section B contains brown concrete, and section C contains gray concrete. By opening the gate 48 for a period of time, with the gates 44, 46 remaining closed, an amount of gray concrete G is deposited onto the belt 50. The gate 48 is then closed, and the gate 46 is then opened so that an amount of brown concrete BR is deposited onto the belt. If desired, the gate 44 can be opened at the same time to simultaneously deposit an amount of black concrete BL, as shown in dashed lines. The gate 46 is then closed and the gate 44 is opened to deposit an amount of black concrete BL onto the belt 50. Simultaneously, the gate 48 can be opened to deposit an amount of gray concrete G, as shown in dashed lines.

The gates 44, 46, 48 control the resulting multi-color concrete blend that will be formed in the hopper 54, and thus the resulting multi-color composition of the blocks. By controlling the length of time that the gates are opened, the amount of each concrete color that is deposited onto the belt 50, and therefore the resulting multi-color blend of the blocks, can be controlled. Gate opening times of between about 4–6 seconds for each gate have been tested successfully. For a discharge opening of about 6.0 inches high and about 12.0 inches wide, approximately 1.0 to 1.5 $ft^3$ of concrete is discharged onto the belt when a gate is opened for four seconds, while approximately 2.0 $ft^3$ of concrete is discharged onto the belt when a gate is opened for six seconds. It is to be realized that other gate opening times could be used.

Further, the speed of the belt 50 also impacts the multi-color blend. A belt speed of about 52.0 ft/min has been tested and has been found to achieve satisfactory color blending. If a different multi-color blend is desired, one or more of the gate opening times, gate opening sequence, and belt speed can be altered to achieve the desired multi-color blend.

For example, to produce a multi-color concrete blend for use in forming a 6"×18"×12" Anchor Highland Stone™ block, available from Anchor Walls Systems, Inc., the assignee of the present invention, the following parameters can be used. First, it is assumed that the concrete will be blended from three colored concretes: brown, gray and charcoal/black, with brown colored concrete being disposed in hopper section A, gray colored concrete disposed in hopper section B, and charcoal colored concrete disposed in hopper section C. Further, the belt speed is approximately 52.0 ft/min.

The multi-color blend is produced by opening gate 44 for a period of about 6 seconds, with the gates 46, 48 remaining closed. This results in the deposit of about 2.0 $ft^3$ of brown colored concrete onto the belt 50. The gate 44 is then closed, and once closed, the gate 46 is immediately opened for a period of about 5 seconds, with the gate 48 remaining closed. This results in the deposit of about 1.75 $ft^3$ of gray colored concrete onto the belt 50. The gate 46 is then closed along with gate 44 which was previously closed, and the gate 48 is opened for a period of about 6 seconds. This results in the deposit of about 2.0 $ft^3$ of charcoal colored concrete onto the belt 50. After the six seconds, the gate 48 is then closed along with the gates 44, 46.

Since the belt 50 is moving, each concrete color is deposited onto the belt at a position that is different from the preceding deposit of concrete, so that the three concrete colors remains substantially separated during delivery to the hopper 54. However, even if the different colored concrete portions were deposited side-by-side on the belt they would remain substantially separated during delivery to the hopper 54. The brown colored concrete will be the first color deposited into the hopper 54, followed shortly thereafter by the gray colored concrete, and followed by the charcoal colored concrete, to produce the multi-color blend. The Anchor Highland Stone™ block is then formed from the multi-color blend.

As the belt 50 deposits each concrete color into the hopper 54, the concrete blends together to produce a multi-color concrete blend. Blocks produced from the multi-color concrete blend have a variegated, or mottled, appearance. Since the blending of the concrete colors occurs in the hopper 54, rather than in the surge hopper 26, there is less time for the colors to bleed together. Thus, the separation between the colors in the resulting blocks is more distinct, with less blurring of the colors at junctures between colors.

With reference to FIG. 3, each hopper section A, B, C includes high and low level sensors 56, 58 therein. When the level of concrete within the particular section falls below the sensor 56, a signal is sent to the mixer 22 to start mixing a new batch of colored concrete for that hopper section. When the level of concrete falls below the sensor 58 within a section, the hopper 26 is prevented from metering further amounts of concrete from that section. Further, the system 20 knows that the section is now capable of receiving the entire batch of concrete from the mixer. Once mixed, the new batch is then delivered to the hopper section to replenish that color.

Therefore, the concrete in each hopper section can be continuously replenished as needed, without having to use up all of the concrete in the hopper 26, and production does not need to be halted to fill the hopper 26. In addition, if one color batch happens to be defective, for example by being formed with too much water, the hopper section containing the defective batch can be emptied without having to empty the other hopper sections. Further, when a decision is made to change the multi-color blended appearance of the blocks, this can be accomplished without having to empty the hopper 26.

The multi-color concrete blend produced in the hopper 54 is used to produce one or more blocks in the production machine 52. To produce blocks, such as retaining wall blocks, a pallet is positioned below a retaining wall block mold, having an open top and bottom, in the production machine 52 to close the open bottom of the mold. The mold cavity can be designed to produce a workpiece that comprises a pair of blocks molded in face to face arrangement, with the workpiece being split after it is cured along the line of intersection of the faces to produce two blocks.

The multi-color blended concrete is delivered from the hopper 54 into the mold through the open top of the mold via one or more feed drawers. The concrete is then densified and compacted by a combination of vibration and pressure. The mold is then stripped by a relative vertical movement of the mold and the pallet to remove the uncured workpiece from the mold. A discussion of a retaining wall block mold that can be used with the present invention, along with a discussion of the block molding process, can be found in U.S. Pat. No. 5,827,015, which is incorporated herein by reference.

The uncured workpiece is then transported away to be cured, after which the workpiece is split in known manner to produce two blocks. Splitting mechanisms are known in the art. An example of a splitting mechanism that could be used with the invention includes U.S. Pat. No. 6,321,740, which is incorporated herein by reference.

By maintaining the same blending conditions to produce the multi-color blend, including the amounts of each concrete color discharged from the hopper 26, the sequence in which the concrete colors are discharged from the hopper 26, and the speed at which the concrete colors are conveyed to the hopper 54, the multi-color blend is generally repeatable, which permits generally repeatable production of blocks having a similar appearance.

Figure 5:
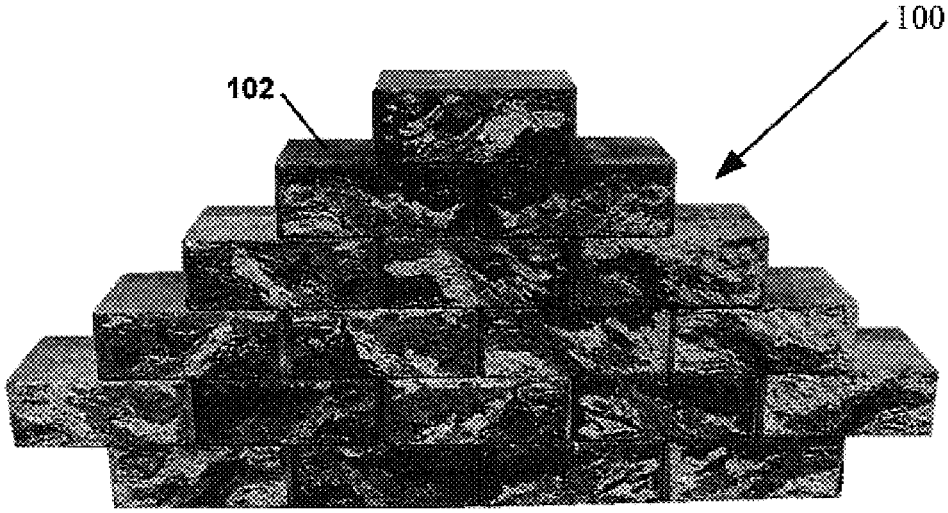
FIG. 5 is a color photograph of a plurality of concrete blocks produced according to the invention and stacked into courses to form a wall.

FIG. 5 is a color photograph of a portion of a wall 100 that is constructed from a plurality of multi-color concrete blocks 102 produced using the process and equipment of the present invention. The blocks 102 were produced using the multi-color concrete blend formulation discussed above for the Anchor Highland Stone™ block. Each block 102 includes a split front face that results from a splitting operation that occurs on a workpiece that comprises two of the blocks formed face to face as discussed above.

The shape of the block 102 can take many forms, depending upon the intended end use of the block. For example, the block 102 can include converging side walls, and an integral locator/shear flange(s) formed on the top and/or bottom face of the block. U.S. Pat. No. 5,827,015 discloses examples of blocks that could be formed utilizing the process and equipment of the present invention.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A process for producing a multi-colored concrete product, the process comprising the steps of:

separately metering concrete from at least two discrete batches of concrete into separate quantities that are separated in a direction perpendicular to a transport direction, one of said discrete batches having a first color and the other of said discrete batches having a second color different from the first color;

transporting the separately metered quantities of concrete in the transport direction to a hopper of a production machine;

depositing the separately metered concrete from the discrete colored concrete batches into the hopper of the production machine to produce a multi-color concrete blend; and producing at least one concrete product from the multi-color concrete blend.

2. The process according to claim 1, wherein the discrete batches of concrete are contained in a hopper that is divided into at least two sections arranged side-by-side in a direction perpendicular to the transport direction, and a first one of said sections contains concrete having the first color and the second section contains concrete having the second color, and further including metering concrete from the first section and metering concrete from the second section.

3. The process according to claim 2, further including sensing the amount of concrete in each hopper section, and depositing additional concrete into one of said hopper sections when the amount of concrete in said hopper section is low.

4. The process according to claim 1, wherein the discrete batches of concrete are contained in a hopper that is divided into at least three sections arranged side-by-side in a direction perpendicular to the transport direction, and each section contains concrete having a color that is different from the colors in the other sections, and further including separately metering concrete from at least two of said sections.

5. The process according to claim 4, further including metering concrete from each said section.

6. The process according to claim 4, further including metering each colored concrete through an opening associated with each section.

7. The process according to claim 6, further including controlling the metering time through each opening.

8. The process according to claim 7, further including controlling the delivery times of the metered concrete to the hopper of the production machine.

9. A process for producing a multi-color concrete blend, comprising the steps of:

transporting concrete from at least two separate batches of concrete to a hopper of a production machine, the transported concrete from each batch comprising separate quantities of concrete that are separated in a direction perpendicular to a transport direction, and a first one of said batches having a first color and a second one of said batches having a second color different from the first color; and after transporting, depositing the transported separate quantities of concrete into the hopper of the production machine to produce a multi-color concrete blend.

10. The process according to claim 9, comprising transporting concrete from at least three separate batches of concrete to the hopper of the production machine, the transported concrete from each batch comprising separate quantities of concrete that are separated in a direction perpendicular to a transport direction, and the three batches each having a color that is different from the colors of the other two batches.

11. The process according to claim 9, further including varying the sequence of delivery of the separate quantities of concrete to the hopper.

12. The process according to claim 11, further including varying the rate of delivery of the separate quantities of concrete from the batches to the hopper.

* * * * *